US006318449B1

(12) United States Patent
Jolivet et al.

(10) Patent No.: US 6,318,449 B1
(45) Date of Patent: Nov. 20, 2001

(54) MOULD HEAD FOR THE VERTICAL HOT-TOP CONTINUOUS CASTING OF METAL PRODUCTS ELONGATE CROSS SECTION

(75) Inventors: Jean-Marc Jolivet, Rurange les Thionville; Eric Perrin, Metz; Jacques Spiquel; Cosimo Salaris, both of Montigny les Metz, all of (FR)

(73) Assignee: Sollac (FR)

( * ) Notice: Subject to any disclaimer, the term of this patent is extended or adjusted under 35 U.S.C. 154(b) by 0 days.

(21) Appl. No.: 09/424,560

(22) PCT Filed: May 26, 1998

(86) PCT No.: PCT/FR98/01042

§ 371 Date: Feb. 7, 2000

§ 102(e) Date: Feb. 7, 2000

(87) PCT Pub. No.: WO98/56521

PCT Pub. Date: Dec. 17, 1998

(30) Foreign Application Priority Data

Jun. 12, 1997 (FR) ..... 97 07413

(51) Int. Cl.[7] ..... B22D 11/124
(52) U.S. Cl. ..... 164/444; 164/487
(58) Field of Search ..... 164/444, 487, 164/418, 459

(56) References Cited

U.S. PATENT DOCUMENTS 5,176,197 1/1993 Hamaguchi et al. ..... 164/418 X
6,050,324 * 4/2000 Jolivet et al. ..... 164/415
6,135,197 * 10/2000 Jolivet et al. ..... 164/418

FOREIGN PATENT DOCUMENTS 0 620 062 10/1994 (EP) .
1 253 787 5/1961 (FR) .
1 358 802 7/1964 (FR) .
2 690 099 10/1993 (FR) .

* cited by examiner

*Primary Examiner*—Tom Dunn
*Assistant Examiner*—Len Tran
(74) *Attorney, Agent, or Firm*—Nixon Peabody LLP; Thomas W. Cole

(57) ABSTRACT

In this type of mold, a feed head (23) made of thermally insulating refractory fits on top of the cooled copper crystallizer (7) being internally aligned with it in order to define a passage for the cast metal, with interposition between the two of an insert (24) made of dense refractory having mechanical strength properties. This insert (24) consists of bars, each bar (29) being formed by a rigid assembly of aligned and juxtaposed contiguous elements (30) kept clamped against each other by a clamp incorporated into the bar, such as a cross-tie (31) associated with compression pads (33), and positioning and aligning the bar on the crystallizer (7) are provided and consist of a battery of spring pushers (38), which battery is associated with a positioning stop (39) on the crystallizer against which the bar (29) presses.

7 Claims, 1 Drawing Sheet

SINGLE PLATE

SINGLE PLATE
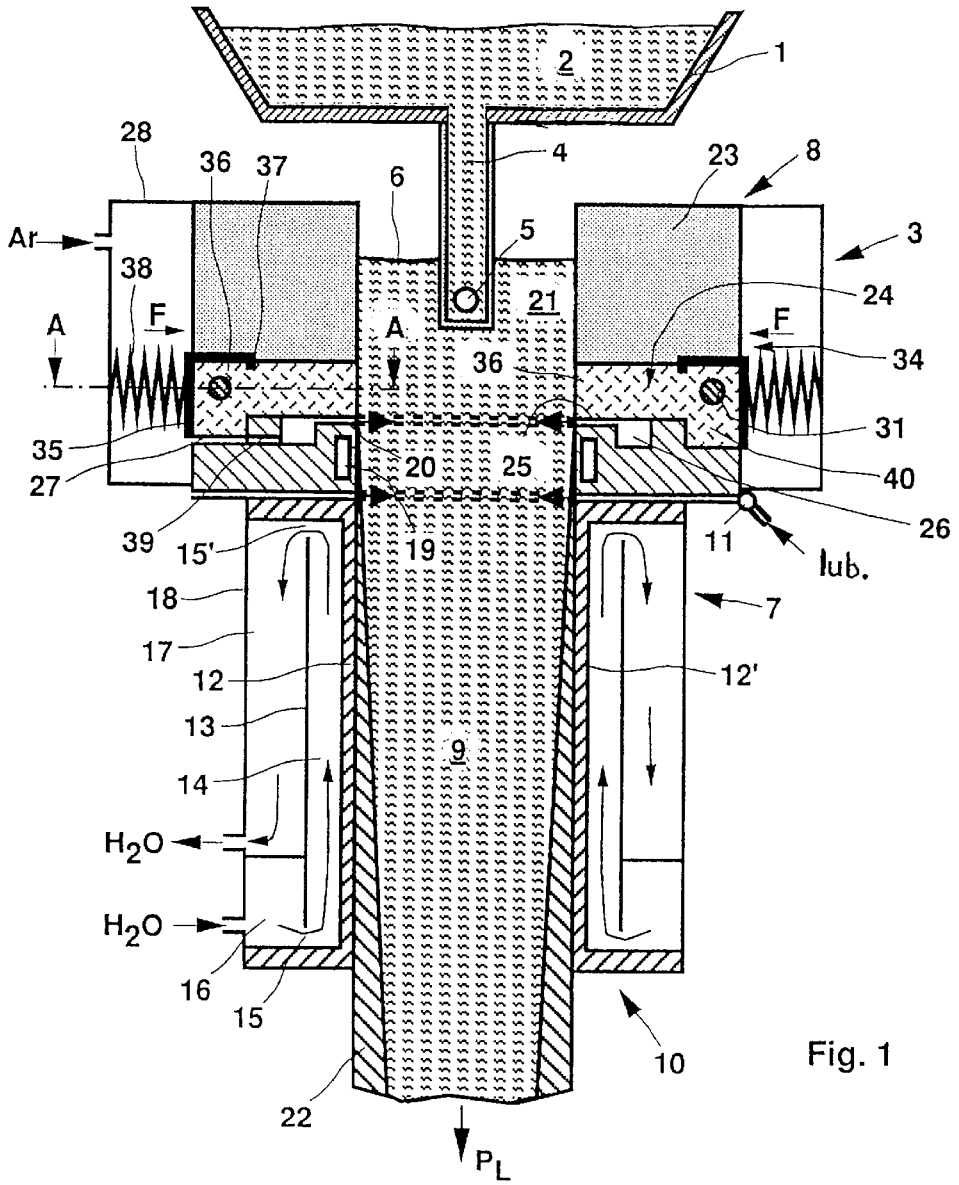
Fig. 1
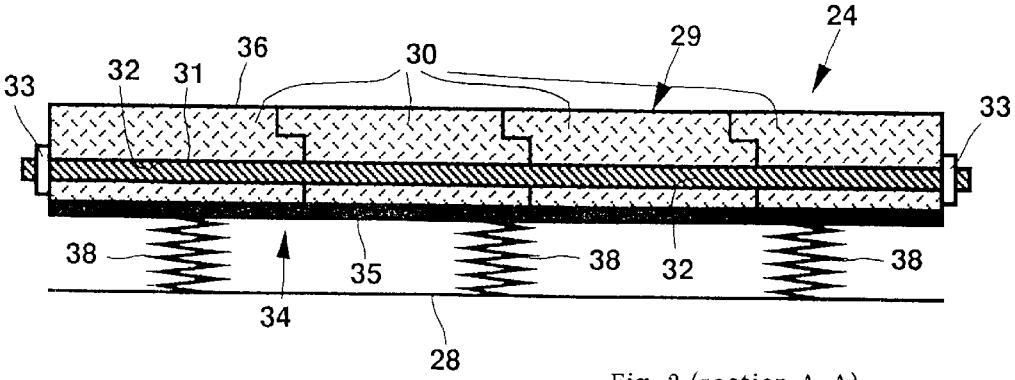
Fig. 2 (section A-A)

MOULD HEAD FOR THE VERTICAL HOT-TOP CONTINUOUS CASTING OF METAL PRODUCTS ELONGATE CROSS SECTION

The invention relates to the hot-top continuous casting of metals, especially steel. It relates more specifically to the hot-top casting of products of elongate cross section, especially of broad cross section, such as slabs, more commonly called "flat products".

In its current state of development, hot-top continuous casting may be regarded as an extension of the conventional continuous casting process, which aims to shift vertically in the mould the point where the cast metal starts to solidify by contact with the internal face of the cooled copper wall, from the point, located above, where the free surface (the "meniscus") of the cast liquid metal lies. It is known that the first solidification takes place by a very sensitive physical mechanism, and at the same time it constitutes an essential factor in the quality of the product obtained. By virtue of the separation in the levels of the above two points, specific to hot-top continuous casting, this solidification takes place at a point which is hydrodynamically calm, far from the permanently disturbed zone formed by the meniscus region. Schematically, this separation of the two levels is produced by sitting on top of the cooled copper body of the mould an uncooled added feed head made of a refractory material having good thermal insulation properties (as it were, a feeder head) which is internally well aligned with the mould and within which the caster will place and maintain the meniscus of cast steel poured from a tundish positioned above it.

Hot-top continuous casting of this type, known for a long time according to these principles, and described for example in FR-2,009,365, has never hitherto been obtained on an industrial scale to the knowledge of the applicants. Their own studies carried out more recently on the subject (see, for example, French Patent Applications Nos. 96/04304 and 96/04305) have shown the great advantage of providing, between the insulating feed head made of refractory and the cooled copper mould which supports it, an insert which is also made of refractory but one which is dense and therefore mechanically stronger than the usual insulating refractories, which are generally fibrous. This inserted piece must in fact be both quite a good thermal insulator in order to keep the molten steel that it will contain in the liquid state in the manner of the feed head, and have good mechanical strength properties in order to preserve for as long as possible the geometry of the upper edge of the copper wall on which it rests, precisely at the point where the cast metal starts to solidify. It is known that a material such as SiAlON® satisfies such conflicting requirements quite well.

However, this type of material is expensive, particularly when it has to be shaped into a ring matching the internal perimeter of the mould. Its cost may even become prohibitive for long inserts, as is the case with moulds having a long solidification perimeter that moulds for casting products with a large cross section, such as slabs, necessarily have. Moreover, and as the studies by the Applicants have also confirmed, it is important for the success of the casting operation to keep the SiAlON in alignment with the mould within very tight tolerance margins (at most 0.1 mm). Such a requirement is all the harder to meet in this case, since the inevitable phenomena of hot differential expansion of the various parts when in contact with the molten metal are a major cause of misalignment. In addition, it should be noted that such phenomena are all the more important the more elongate the mould, which is particularly the case of the casting of steel slabs (whose width may conventionally reach or even exceed 1800 mm).

The object of the present invention is to provide a simple, reliable and inexpensive solution to the aforementioned difficulties encountered with the casting of products of broad cross section.

For this purpose, the subject of the invention is a mould head for the vertical hot-top continuous casting of metals, particularly steel, comprising a feed head made of thermally insulating refractory, which sits on top of the cooled metal crystallizer of the mould (generally made of copper or copper alloy) which is internally aligned with it and includes, between the feed head and the crystallizer, an insert made of dense refractory having mechanical strength properties (for example SiAlON) and shaped in the form of a ring so as to be able to match the internal periphery of the mould, characterized in that the said insert consists of bars, each bar being formed from a rigid assembly of juxtaposed and aligned contiguous elements which are kept clamped against each other by a clamping means incorporated into the said bar, and in that means for aligning the said bar with the body of the mould are provided and consist of a pusher associated with a positioning stop made on the cooled copper body, against which stop is pressed the said assembly subjected for this purpose to the action of the pusher which tends to continuously push it back towards the inside of the mould.

Several assemblies of this type, butted together one after the other with suitable connecting corners (generally right-angled corners since the continuous cast products are ordinarily of rectangular cross section), will form an insert in its desired final geometry for matching the perimeter of the mould.

In a preferred embodiment of the invention, the integrated clamping means consists of a threaded cross-tie in the long direction and associated with clamping nuts (more generally clamping pads) which are provided at least so as to bear on the free front face of the elements located at each end of the assembly. Advantageously, the cross-tie is placed in an offset position near the "cold" face of the assembly, that is to say its rear face on the opposite side from the front "hot" face intended to be brought into contact with the molten metal to be cast.

Also preferably, intermediate clamping nuts are also provided so as to bear against the internal front faces of the various elements so as to put each of the elements in mechanical compression in the long direction.

According to another advantageous embodiment of the invention, the assembly of constituent elements of the insert is provided, apart from the aforementioned overall clamping means, with means for mechanically stiffening the "cold" face.

As will doubtlessly have already been understood, the invention consists, in its essential characteristics, in constructing a long straight bar of compact refractory (which it will be assumed hereafter to be of SiAlON in order to be specific) from elements which are possibly identical, in all cases dressed as required in order to allow, of course, the joints between them to be sealed, and butted together one after the other over a distance corresponding to the desired length of the bar, and then joined together into a whole made rigid with the aid of intrinsic clamping means designed also to ensure that the assembly is mechanically strengthened. Thus, a SiAlON bar of a desired length is produced which is much less expensive and much stronger than an equivalent monolithic bar that might be available commercially.

Consequently, this increased strength makes it possible to adopt alignment solutions which are unsophisticated but nevertheless precise and reliable, of the "stop+ pusher" type, which could not be applied to fragile or brittle members.

The invention will be better understood and further aspects and advantages will become even more clearly apparent from the description which follows, given by way of a non-limiting illustrative example and with reference to the single plate of drawings, in which:

FIG. 1 is a view, in vertical cross section, of the head of a machine for the continuous casting of steel slabs according to the invention, on the mid-plane perpendicular to the large faces of the mould;

FIG. 2 is a view, in cross section, of the top of FIG. 1 in the plane of section A—A.

Referring to the general view in FIG. 1, it may be seen that the head of a machine for the vertical hot-top continuous casting of steel slabs has, in the direction PL of extraction of the metal product to be produced, that is to say from the top downwards in the figure, a tundish 1 containing a bath of molten metal 2, which it delivers to a mould 3 (or several such moulds) placed underneath by means of a submerged nozzle 4 (or several such nozzles) whose lateral metal outlet holes 5 emerge some ten centimetres below the free surface 6 (or "meniscus") of the liquid metal present in the mould 3.

As may be seen, this mould comprises two stages 7 and 8.

The lower stage 7 constitutes the crystallizer, also called the "body" of the mould. This body, made of copper or more generally of copper alloy, cooled by the circulation of water, has an internal passage 9 for the cast metal, in which passage the latter, in contact with the cold metal walls, gradually solidifies from the periphery towards the centre as the cast product PL gradually moves downwards within the mould.

The crystallizer 7 itself is preferably formed from two superposed parts, namely a main part 10 which is extended at the top by an auxiliary part 11 well fitted to and internally aligned with the bottom part 10 in order to provide the cast product with a uniform and continuous passage.

In the case of the continuous casting of slabs, the bottom part 10 conventionally consists of four plates (or walls) joined together at right angles, namely two large walls 12 and 12' facing each other and two small end walls or side walls, not visible in the figure. These four walls, the internal face of which is intended to come into contact with the cast metal, are vigorously cooled by the circulation of water along their external face. Conventionally, a steel jacket 13 is provided a short distance from each plate 12, 12' in order to channel a sheet of water 14 preferably flowing vertically. The jacket 13 has, at its ends, passages 15 and 15' which bring the sheet of water 14 into communication with an injection chamber 16 and with a discharge chamber 17 located above, these chambers being bounded by an external partition 18 placed some distance behind the jacket 13.

The added upper part 11 forms a ring cooled by internal circulation of water in a channel 19 made as close as possible to its upper edge 20 on which the cast metal will start to solidify. The role of the ring 11 is specifically to provide proper thermal protection of this edge 20 which will be thermomechanically very highly stressed during casting, by cooling the said edge appreciably more effectively than can be done by the cooling circuit, using the sheet of water 14, used to cool the main part 10 consisting of assembled plates. The cooled ring 11 is dressed at its base so as to closely match the upper surface of the tubular assembly 10 on which it rests, and thus to avoid any risk of infiltration of molten metal.

The upper stage 8 is formed by a feed head made of uncooled refractory, the internal wall of which, for the same reasons as above, is preferably aligned with that of the body of the crystallizer 7 (and in all cases, not set back).

With regard to the casting process, the "cooled metal crystallizer 7 surmounted by the insulating refractory feed head 8" arrangement defines, for the cast metal $P_L$, a calibrating passage whose upper portion 21 within the feed head constitutes a buffer region for confining the hydrodynamic perturbations caused by the influx of molten metal into the mould through the holes 5 in the nozzle 4 and whose portion 9, which extends it downwards, is a zone for solidification of the cast a metal.

This solidification, as may be seen, starts as soon as the cast steel first comes into contact with the cold metal wall of the crystallizer 7, namely on the upper edge 20 of the copper ring 11, and continues downstream, forming a solid shell 22 whose thickness increases from the periphery towards the centre. On leaving the mould, the shell 22 with a thickness of slightly more than 1 cm, is strong enough to withstand the ferrostatic pressure of the still-liquid core and continuous its centripetal growth until complete solidification of the cast product $P_L$ under the effect of water-spray rails, not shown, located in the bottom half of the machine. Once completely solidified, the product obtained is cut into sections of the desired length (the slabs) which are then available for subsequent shaping (rolling, etc).

As may be seen, this refractory feed head 8 is itself formed from two separate superposed elements:

- an upper sleeve 23 made of a refractory chosen for its thermal insulation properties, since it has to prevent any premature parasitic solidification of the cast metal in the turbulent zone 21. The material opted for is a fibrous refractory, for example the material sold under the name A 120K by the company KAPYROK;
- and a lower element 24, called an "insert", made of a refractory chosen for its good mechanical strength, which is therefore dense, since it must withstand as far as possible, near the crystallizer 7, the mechanical erosion of the upper tip of the solid shell 22 on the edge 20 of the cooled metal ring 11, while the assembly is subjected to the usual vertical oscillation movement necessary for the success of the casting operation as well as to the thermomechanical stresses of a machine operating by thermal cycles imposed by the necessarily sequential character of the casting process itself. Such a material as SiAlON (Sialon (R)), advantageously doped with boron nitride, may be perfectly suitable.

The advantage of a feed head 8 made in two superposed parts 23, 24 stems from the fact that the mechanical strength of the bottom part, subjected to the erosion caused by the "to-and-fro" movements of the point of solidification of the cast metal which are caused by the vertical oscillations of the mould, can be improved. On the other hand, this strong, lower insert 24 is inevitably less thermally insulating than the upper sleeve 23. There is therefore, in contact with its internal wall aligned with that of the cooled ring 11, the possible formation of a film of premature parasitic solidification of the cast metal. This film is an important heterogeneity factor with regard to the controlled solidification process which has to take place in the crystallizer 7.

It is for this reason that it is advantageous, in accordance with an implementation of hot-top casting already known from elsewhere (FR-A-93/03871), to blow in a curtain of gas at the base of the feed head 8 for the purpose of breaking up the film of parasitic solidification created on the insert 24 and therefore allowing uniform and sharp initiation of the solidification of the cast metal in contact with the cooled ring 11. For this purpose, a circuit for injecting a lost inert gas (for example argon) is provided between the feed head 8 and the crystallizer 7. This circuit comprises an annular slot 25 made at the feed head/crystallizer interface and emerging at one end on the internal perimeter of the mould and connected at its other end to a delivery chamber 26 fed with argon via a calibrated inlet 27 which is itself connected to an argon source (not shown) via a pressurized box 28 surrounding the feed head 8. This arrangement has the advantage of preventing any risk of oxidation of the cast liquid metal within the mould by the oxygen of the air through the insulating refractory mass 23 which is inevitably somewhat permeable.

According to the invention, the SiAlON insert 24 is not a single piece but made from juxtaposed contiguous elements kept rigidly clamped against each other by a clamping means incorporated into the insert. One embodiment may be seen in FIG. 2, which shows a bar making up the insert as it appears on each of the large faces of the mould. Of course, the insert goes around the internal periphery of the mould. Once mounted, it therefore is in the form of a rectangular frame whose short or long sides are formed by straight bars shaped like the one, 29, shown in FIG. 2.

As may be seen, a bar 29 consists of the assembly of juxtaposed contiguous elements 30 kept rigidly clamped against each other by a clamping means incorporated into the bar itself. In the example described, this clamping means intrinsic to the bar is a clamp composed of a tie 31 passing right through each element by going through a passage 32 made for this purpose in each of them, this tie, threaded at least at its ends projecting from the assembly, being associated with clamping nuts 33 screwed onto these ends so as to bear on the free front faces of the end elements 30. Such a clamping means is called an "overall action" clamping means because, like a vice, it puts the assembly of elements into mechanical compression by acting only on the end elements of the bar. Of course, provision may also be made to prestress each element individually by means of the tie 31. To do this, all that is required is to have a tie threaded over its entire length and to add intermediate nuts at the junction between two elements 30.

It is advantageous, as shown in FIG. 2, to shape the contiguous front faces of the elements 30 in order to favour their interlocking and consequently their alignment as well as the sealing of the junction zones with respect to possible infiltration of cast liquid metal because of the ferrostatic pressure in the mould at the height where the insert 24 is located.

Preferably, the tie is in a position offset towards the "cold" face of the bar (towards the bottom in the figure). Compared with the "hot" face intended to come into contact with the molten metal, the "cold face" is that face of the insert on the opposite side from the "hot" face and therefore less thermally stressed. The offset of the location of the tie 32 towards this cold face has the purpose of preventing the tie, generally made of steel, from heating up too much by being too close to the hot face, which would have the consequence of possibly causing the assembly to become disassembled as a result of excessively large differential expansion effects.

Such preferential compression of the cold face has another advantage. Since the refractory insert 24 is intended as a transition piece between the cooled metal crystallizer 7 and the insulating refractory sleeve 23, it is necessarily a poor heat conductor. There will therefore always be a significant thermal gradient between its hot face and its cold face. In addition, it will therefore always be the seat of large differential expansion effects in its thickness. Preferably putting its cold face under a compressive prestress will thus help to counteract any subsequent tendency towards cracking, which otherwise might be caused by it being put under tension during expansion of the hot face in contact with the molten metal.

The offset of the clamping tie 31 also has the additional advantage of being able to reduce, as required, the thickness of the insert 24, for example during operations to recondition the hot face after it has worn away.

According to a preferred embodiment, means for stiffening the cold face of the bar are provided. In order to avoid any risk of buckling, which would give the bar a "banana" shape because of the "cantilever" effect of the clamping by the offset tie 31, it is advantageous to stiffen the cold face of the bar 29. This function may be simply provided by a shell 34, more clearly visible in FIG. 2. This shell, in the form of an "L" with a slightly acute angle, is made of spring steel: the bottom plate 35 is applied intimately against the cold face of the bar, being held there elastically by its lateral cheek 36 anchored in the material of the insert 24 with the aid of its bent-over edge 37 engaged in a notch provided for this purpose on the lateral face (in this case, the upper face) of the bar.

Fitting the bar 29 correctly into the mould consists in allowing its hot face 36 to be flush with the internal surface of the mould, very uniformly over its entire length, which may reach and even exceed 1.5 m, depending on the width of the cast slab. According to an essential characteristic of the invention, this result is achieved by virtue of means of aligning the bar, consisting in permanently pushing it elastically towards the interior of the mould against a stop integral with the copper upper ring 11 of the crystallizer 7. Specifically, such means may simply consist, on the one hand, of a battery of springs 38 which is placed opposite the cold face of the bar and on which the springs act, by them fixedly bearing on the partition of the box 28 and, on the other hand, of a stop 39 obtained by machining the upper face of the cooled ring 11. In the example described, this stop is in the form of a tongue so as at the same time to constitute a partition delimiting the distribution chamber 26 for the flow of argon emerging around the internal perimeter of the mould just below the refractory insert 24.

Of course, the lower face of the bar 29 must also be machined correspondingly, in order to present a shoulder 40, which may be seen in the view of FIG. 1, which engages with the stop 39.

It goes without saying that the invention is not limited to the example described, but extends to many variants or equivalents provided that its essential characteristics given in the appended claims are reproduced.

Thus, there is no limitation to the number or the length of the individual elements 30 making up a bar 29, which elements may or may not have, moreover, the same length. Likewise, although preferably regarded as a single bar, several bars such as 24 may be put end to end in order to occupy the width of a large face of the mould.

Moreover, it is not absolutely essential for the clamping tie to pass through the elements 30. It is in fact possible, as long as there is compatible space at this point in the mould, to provide an external tie going along the cold face of the bar and provided at its ends with two jaws in the manner of a conventional G-clamp.

It should furthermore be noted that, although the invention has been initially made specifically for the casting of slabs and other products of elongate cross section, it nevertheless remains applicable to the casting of products of any cross section insofar as, of course, such products may be cast using the technique of hot-top continuous casting.

Likewise, the invention applies to the continuous casting not only of steel but of any metal capable of being continuously cast and especially metals having a lower melting point than steel, such as aluminium or copper.

What is claimed is:

1. A mould head for the vertical hot-top continuous casting of metals, comprising a feed head made of a thermally insulating refractory, which fits on a cooled metal crystallizer of the mould head, being internally aligned with the latter in order to define a continuous and uniform passage for the cast metal, and comprising, between the feed head and the crystallizer, an inset made of a dense refractory material having mechanical strength properties and shaped so as to be flush with the internal periphery of the mould head, which mould head is characterized in that said insert comprises at least one bar, the bar being formed from a rigid assembly of juxtaposed and aligned contiguous elements which are kept clamped against each other by a clamping means incorporated into said bar and in that means for positioning and aligning said bar with the crystallizer of the mould head are provided and comprise a battery of pushers which are associated with a positioning stop on said crystallizer, against which stop is pressing the bar subjected for this purpose to the action of the pushers which permanently tend to push the bar back towards the inside of the mould head.

2. A mould head for vertical hot-top continuous casting according to claim 1, characterized in that the clamping means consists of a tie associated with compression pads which bear at least an the front end faces of the bar.

3. A mould head for vertical hot-top continuous casting according to claim 2, characterized in that the tie passes through the elements making up the bar which has a passage for this purpose.

4. A mould head for vertical hot-top continuous casting according to claim 3, characterized in that the passage made in the bar for fitting the tie is offset towards a cold face of the bar.

5. A mould head for vertical hot-top continuous casting according to claim 3, characterize in that intermediate compression pads art present on the tie in the junction region of the elements.

6. A mould head for vertical hot-top continuous casting according to claim 4, characterized in that for stiffening the cold face of the bar are provided.

7. A mould head for vertical hot-top continuous casting according to claim 6, characterized in that the said stiffening means consist of a metal shell profiled in the form of an L-shape whose bottom plate is pressed elastically against the cold face of the bar.

* * * * *

UNITED STATES PATENT AND TRADEMARK OFFICE

CERTIFICATE OF CORRECTION

PATENT NO. : 6,318,449 B1 
DATED : November 20, 2001
INVENTOR(S) : Jean-Marc Jolivet, Eric Perrin, Jacques Spiquel and Cosimo Salaris It is certified that error appears in the above-identified patent and that said Letters Patent is hereby corrected as shown below:

Column 8,
Line 4, please change “an” to -- on --,
Line 19, please insert -- means -- after “that”.

Signed and Sealed this

Thirtieth Day of July, 2002

*Attest:*

*Attesting Officer*

JAMES E. ROGAN
*Director of the United States Patent and Trademark Office*